US007866911B2

(12) United States Patent
Saadi et al.

(10) Patent No.: US 7,866,911 B2
(45) Date of Patent: Jan. 11, 2011

(54) SLOTTED DRAIN

(75) Inventors: Robert E. Saadi, Erie, PA (US); Kevin Himes, Mount Wolf, PA (US); Douglas Dalton, Jamestown, NY (US); David A. Ecklund, Jamestown, NY (US); Joseph Sanfilippo, Jamestown, NY (US); Patrick Slater, Waterford, PA (US); William A. Verdecchia, Erie, PA (US); Doug Wroblewski, Wattsburg, PA (US)

(73) Assignee: Zurn Industries, LLC, Erie, PA (US)

( * ) Notice: Subject to any disclaimer, the term of this patent is extended or adjusted under 35 U.S.C. 154(b) by 655 days.

(21) Appl. No.: 11/545,722

(22) Filed: Oct. 10, 2006

(65) Prior Publication Data

US 2007/0099782 A1 May 3, 2007

Related U.S. Application Data

(60) Provisional application No. 60/724,680, filed on Oct. 7, 2005.

(51) Int. Cl.
*E01C 11/22* (2006.01)
*E02B 11/00* (2006.01)
*F16L 9/00* (2006.01)

(52) U.S. Cl. ..... 404/4; 404/2; 138/162; 405/43

(58) Field of Classification Search ..... 404/2, 404/3, 4; 405/36, 43; 138/162; 285/921
See application file for complete search history.

(56) References Cited

U.S. PATENT DOCUMENTS

| | | | | | |
|---|---|---|---|---|---|
| 320,667 | A | * | 6/1885 | Marquis | 137/356 |
| 826,414 | A | | 7/1906 | Feltz et al. | |
| 1,044,044 | A | | 11/1912 | Hardesty | |
| 1,049,543 | A | | 1/1913 | Smith | |
| 1,700,889 | A | | 2/1929 | Heltzel | |
| 1,883,468 | A | * | 10/1932 | Barbour | 210/293 |
| 1,892,842 | A | * | 1/1933 | Kimberling | 210/293 |
| 3,468,130 | A | * | 9/1969 | Gibson | 405/39 |
| 4,365,911 | A | | 12/1982 | Rossberg | |
| 4,490,067 | A | | 12/1984 | Dahowski | |
| 4,522,531 | A | * | 6/1985 | Thomsen et al. | 404/2 |
| 4,640,643 | A | * | 2/1987 | Williams | 404/4 |
| 4,648,739 | A | * | 3/1987 | Thomsen | 404/2 |
| 4,667,702 | A | * | 5/1987 | Roth | 138/162 |
| 4,787,773 | A | | 11/1988 | Kehler | |
| 4,815,888 | A | * | 3/1989 | Stegmeier | 404/4 |
| 4,948,293 | A | * | 8/1990 | Smith | 405/36 |

(Continued)

*Primary Examiner*—Thomas B Will
*Assistant Examiner*—Abigail A Risic
(74) *Attorney, Agent, or Firm*—The Webb Law Firm

(57) ABSTRACT

A slotted drain having a first channeled half having a first engaging structure and a second channeled half having a second engaging structure mating within the first engaging structure is disclosed. The first channeled half can define a cantilever snap-fit recess and the second channeled half can comprise a cantilever snap-fit protrusion. A slot is formed when the first and second channeled halves are joined. The slot is adapted to receive a liquid variant and the slotted drain is adapted to receive the liquid from the slot into the first and second channeled halves. The slotted drain may optionally include a concrete pass-through port, a rebar clip, bedding feet and/or securement ribs. A method of assembling a slotted drain is also disclosed.

30 Claims, 9 Drawing Sheets

U.S. PATENT DOCUMENTS 4,948,295 A * 8/1990 Pramsoler ..... 405/44
5,226,748 A 7/1993 Bärenwald et al.
5,380,121 A 1/1995 Schluter
5,489,163 A 2/1996 Thomann
5,538,361 A * 7/1996 Beamer ..... 405/118
5,564,857 A 10/1996 Schluter
5,573,351 A * 11/1996 Beamer ..... 405/119
5,645,367 A * 7/1997 Gunter ..... 404/3
5,718,537 A * 2/1998 Becker et al. ..... 405/119
5,875,821 A * 3/1999 Dumser et al. ..... 138/162
5,908,266 A 6/1999 Miller
5,971,662 A 10/1999 Becker et al.
6,113,311 A 9/2000 Becker et al.
6,170,796 B1 1/2001 Gunter
6,311,734 B1 * 11/2001 Petrovic ..... 138/110
6,390,139 B1 * 5/2002 Kang et al. ..... 138/120
6,612,780 B2 9/2003 Dahowski et al.
6,663,317 B1 12/2003 Williams et al.
6,792,723 B2 9/2004 Stegmeier, Sr. et al.
6,905,285 B2 * 6/2005 Little et al. ..... 405/36
7,008,137 B2 * 3/2006 Muller ..... 405/38
7,044,169 B2 * 5/2006 Kondou et al. ..... 138/167
7,134,808 B2 * 11/2006 Albone et al. ..... 405/126
7,264,418 B1 * 9/2007 Houck et al. ..... 405/43
7,513,712 B2 * 4/2009 Hanstvedt ..... 405/118
2003/0228193 A1 12/2003 Little et al.
2004/0005194 A1 1/2004 Williams et al.
2004/0136785 A1 * 7/2004 Gunter ..... 405/118

* cited by examiner

SLOTTED DRAIN

CROSS REFERENCE TO RELATED APPLICATIONS

This application claims the benefit of U.S. Provisional Application Ser. No. 60/724,680 filed Oct. 7, 2005, the entire contents of which is hereby incorporated by reference.

BACKGROUND OF THE INVENTION

1. Field of the Invention

The present invention relates generally to a slotted drain and, more particularly, to a slotted drain including a first channeled half having a first engaging structure and a second channeled half having a second engaging structure mating with the first engaging structure.

2. Description of Related Art

Slotted drains, or slot drains, typically comprise U-shaped or V-shaped troughs embedded beneath the ground surface, and have relatively narrow slots or throats extending upwardly from the trough to the ground surface. Liquid present on the surface of the ground can enter the slotted drain through the opening in the throat and falls into the trough where it can be transported, for example, to a drainage sewer. An advantage of slotted drains is that, although the drainage opening on the surface is small, the trough along which the liquid is carried to the drainage outlet is large. Accordingly, such drainage systems can cope with heavy rainfall without requiring a large opening to be present within the ground surface. This is useful in situations such as, for example, roads and/or walkways where surface liquid can be undesirable and where large drainage openings are infeasible. Typically, slot drains are installed underground such that an opening is positioned at ground level, and the drain is subsequently secured in place with concrete. Transportation and installation of conventional slotted drains can be cumbersome and time consuming.

Accordingly, a need remains for a slotted drain that is easy to install, transport, and assemble that provides a structure suitable for allowing a significant amount of surface liquid to be directed to a drainage sewer in an efficient manner. The present invention has been developed in view of the foregoing.

SUMMARY OF THE INVENTION

The present invention is directed to a slotted drain that is fabricated in two separate halves. The opposing halves are joined together to form the slotted drain and are secured together by corresponding engaging structures, such as cantilever snap-fit protrusions and recesses.

It is an aspect of the present invention to provide a slotted drain including a first channeled half having a first engaging structure, and a second channeled half having a second engaging structure mating within the first engaging structure.

It is another aspect of the present invention to provide a slotted drain including a first channeled half having a cantilever snap-fit recess, and a second channeled half having a cantilever snap-fit protrusion structured and arranged for receipt within the cantilever snap-fit recess, wherein a slot is formed when the first channeled half and the second channeled half are joined.

It is yet another aspect of the present invention to provide a method of assembling a slotted drain including providing a first channeled half having a cantilever snap-fit protrusion to an area of assembly, providing a second channeled half having a cantilever snap-fit recess to the area of assembly, and engaging the cantilever snap-fit protrusion within the cantilever snap-fit recess.

These and other advantages of the present invention will be understood from the description of the preferred embodiments, taken with the accompanying drawings, wherein like reference numerals represent like elements throughout.

DETAILED DESCRIPTION OF THE INVENTION

For purposes of the description hereinafter, spatial or directional terms shall relate to the invention as it is oriented in the figures. However, it is to be understood that the invention may assume various alternative variations, except where expressly specified to the contrary. It is also to be understood that the specific components illustrated in the attached drawings, and described in the following specification, are exemplary embodiments of the invention. Hence, specific dimensions and other physical characteristics related to the embodiments disclosed herein are not to be considered as limiting.

Figure 1:
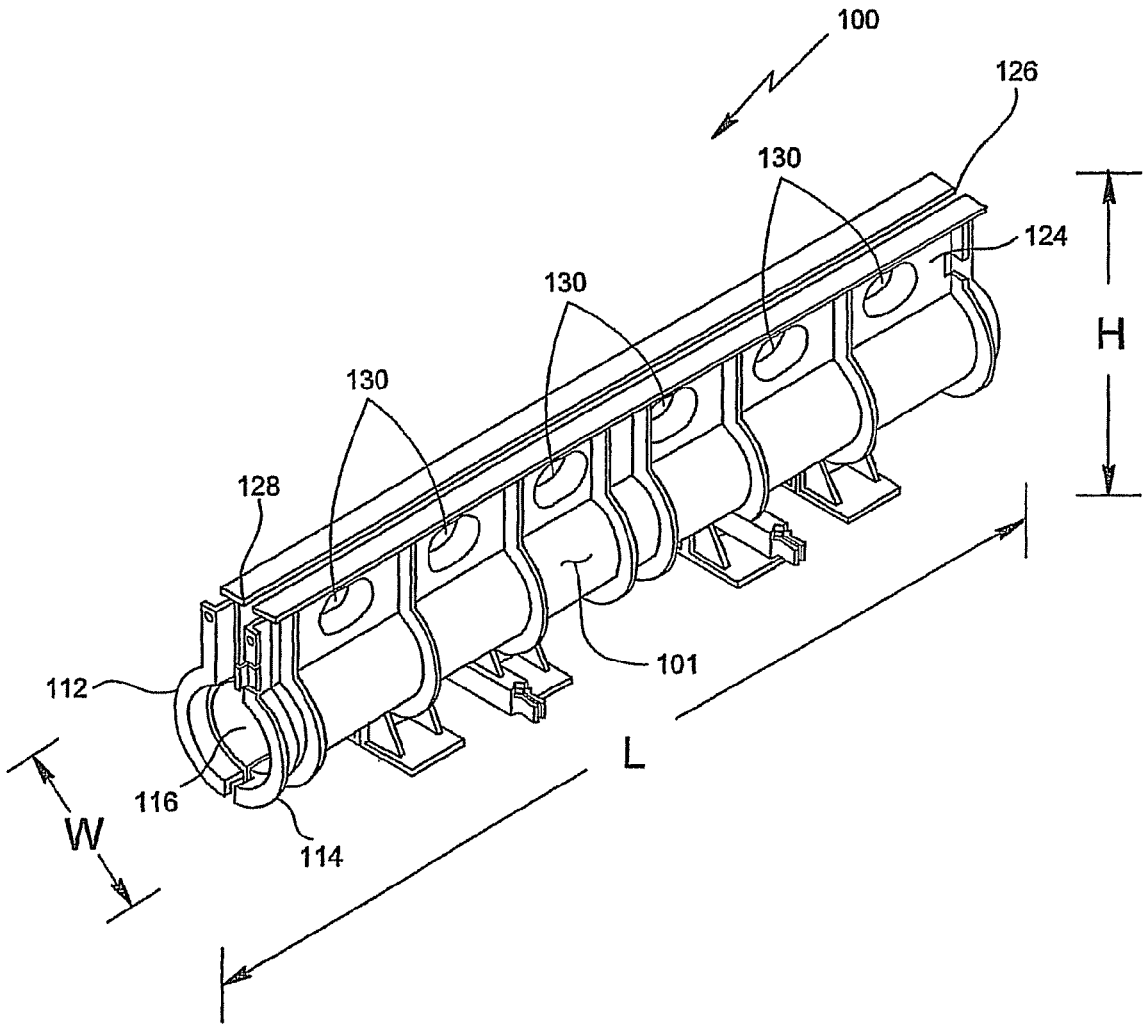
FIG. 1 is a perspective view of a slotted drain in accordance with an embodiment of the present invention.

As shown in FIG. 1, the assembled slotted drain 100 of the present invention includes a joined first channeled half 112 and second channeled half 114. In use, the slotted drain 100 can be positioned at least partially below ground such that a slot 126 formed between the first channeled half 112 and the second channeled half 114 can receive liquids, such as ground water, therein. The slot 126 is in fluid communication with a pipe interior 116 and allows liquid entering the slot 126 to pass therethrough. In one embodiment of the present invention, the pipe interior 116 is in flow communication with additional drainage piping, sewers, collection tanks, and the like (not shown). In another embodiment, the pipe interior can include a standard pipe diameter, such as from about 2 inches to about 10 inches.

The slotted drain 100 of the present invention can be made of any suitable material, preferably a polymeric material, such as Polyethylene, High Density Polyethylene (HDPE), or other plastic materials, and/or metals and/or metal alloys, such as steel, galvanized steel, or stainless steel, optionally coated with a corrosion resistant coating. Preferably, each first channeled half 112 and second channeled half 114 are molded polymeric material so that each channeled half 112, 114 is a unitary molded piece. The slotted drain 100 can have any suitable length L, such as, for example, from about one foot to about twenty feet, any suitable height H, such as, for example, from about eight inches to about twenty-four inches, and any suitable width, such as, for example, about four inches.

As shown in FIG. 1, the slotted drain 100 can include a neck portion 124 extending between, and in flow communication with, a fluid entrance 128 of the slot 126 and the pipe interior 116. In one embodiment, the neck portion can include a plurality of concrete pass-through ports 130 structured and arranged to allow wet concrete to pass therethrough during installation and/or securement of the slotted drain 100 within the ground. The concrete pass-through ports 130 are isolated from the fluid path extending between the slot 126 and the pipe interior 116. During installation, the assembled slotted drain 100 can be placed into a trench recessed from the ground surface, and concrete, gravel or other like stabilizing material can be deposited around a surface 101 of the slotted drain 100, thereby anchoring it in place. In one embodiment, the concrete, gravel or other stabilizing material does not contact or otherwise interfere with the fluid entrance 128 of the slotted drain 100. In another embodiment, a stabilizing material may be deposited around the slotted drain 100 and to a depth that is flush with the fluid entrance 128 but does not interfere with liquid passing therethrough. The concrete pass-through ports 130 allow for concrete, gravel or other like material to pass through a portion of the slotted drain 100 to further secure it in place without directly contacting the liquid flowing from the slot 126 into the pipe interior 116. The concrete pass-through ports 130 can have any suitable shape, such as oval, circular, square, rectangular, and the like. In one embodiment, the concrete pass-through ports have a four inch diameter, or larger.

Figure 2:
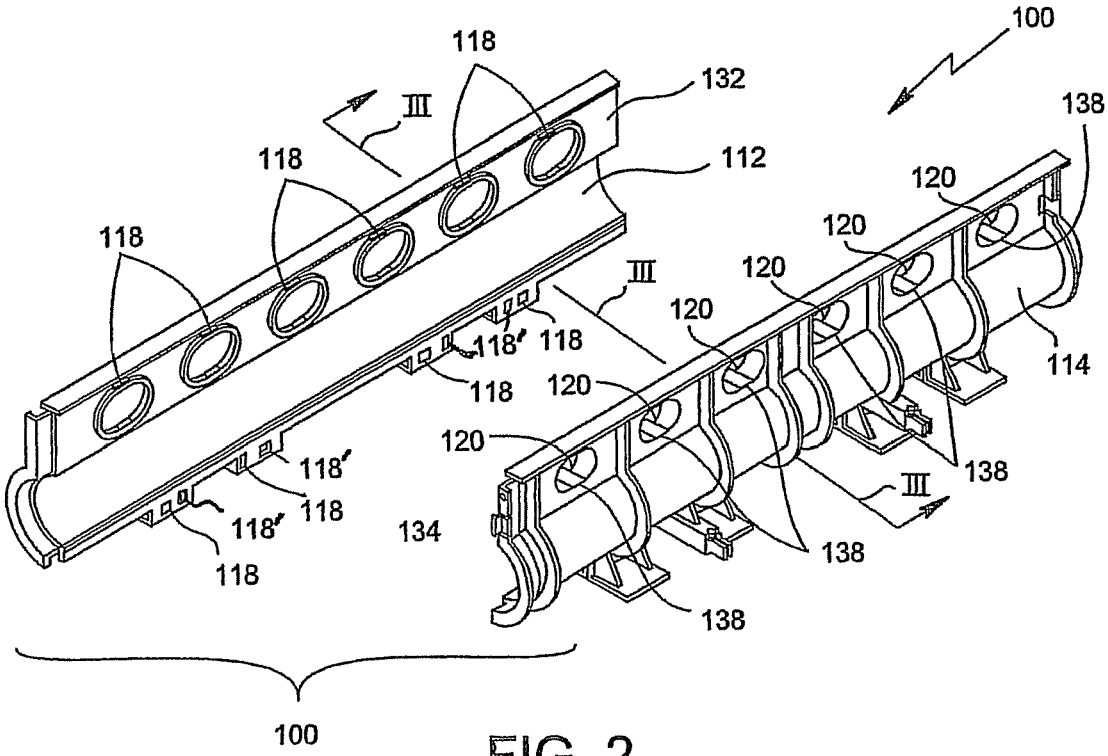
FIG. 2 is a perspective view of an unengaged first channeled half of a slotted drain and a corresponding second channeled half of the slotted drain in accordance with an embodiment of the present invention.
Figure 3:
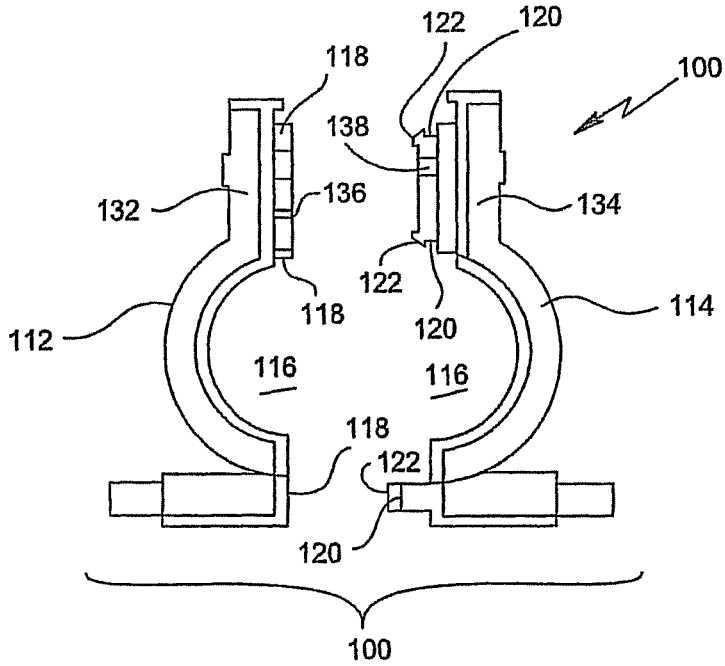
FIG. 3 is a side elevation view of the unengaged first channeled half and the second channeled half of FIG. 2 along III in accordance with an embodiment of the present invention.
Figure 9:
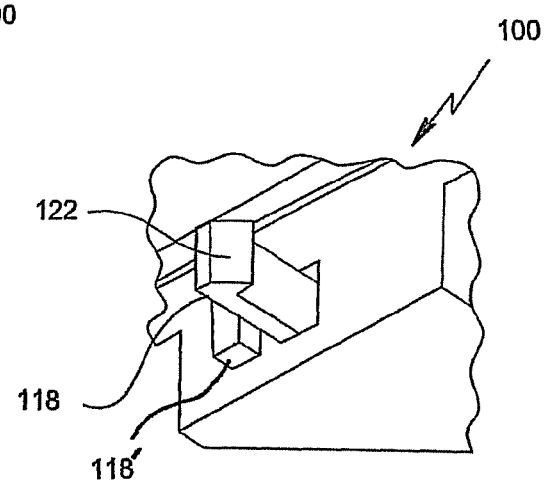
FIG. 9 is a perspective view of a cantilever snap-fit protrusion on a bottom portion of second channeled half of a slotted drain in accordance with an embodiment of the present invention.

As shown in FIGS. 2 and 3, the unassembled slotted drain includes a first channeled half 112 having at least one first engaging structure 118 and a second channeled half 114 having at least one second engaging structure 120. The first engaging structure 118 and the second engaging structure 120 are capable of engaging to secure the first channeled half 112 and the second channeled half 114 to form an assembled slotted drain 100, as shown in FIG. 1. Guides 118' are provided adjacent to respective first engaging structures 118. Guides 118' are adapted to be received in openings 120' positioned adjacent to respective second engaging structures 120 (shown in FIG. 9) when a respective first channeled half 112 and a second channeled half 114 are connected. In one embodiment, the second engaging structure 120 is structured and arranged to mate within the first engaging structure 118. The first engaging structure 118 can define a recess and the second engaging structure 120 can include a protrusion structured and arranged for receipt within the recess. In one embodiment, the first engaging structure 118 defines a snap-fit recess and the second engaging structure 120 includes a snap-fit protrusion for receipt within the snap-fit recess. In another embodiment, the first engaging structure 118 defines a cantilever snap-fit recess and the second engaging structure includes a cantilever snap-fit protrusion for receipt within the cantilever snap-fit recess.

Referring again to FIGS. 2 and 3, the cantilever snap-fit protrusion can include at least one restraining tip 122 for further securing the second engaging structure 120 within the first engaging structure 118. The restraining tip 122 can have any suitable dimensions so as to provide resistance against the first engaging structure 118, such as a flexible wedge. During installation, the first channeled half 112 and the second channeled half 114 can be provided to a desired area of assembly and the cantilever snap-fit recess of the first channeled half 112 can be engaged with the cantilever snap-fit protrusion of the second channeled half 114.

Figure 4:
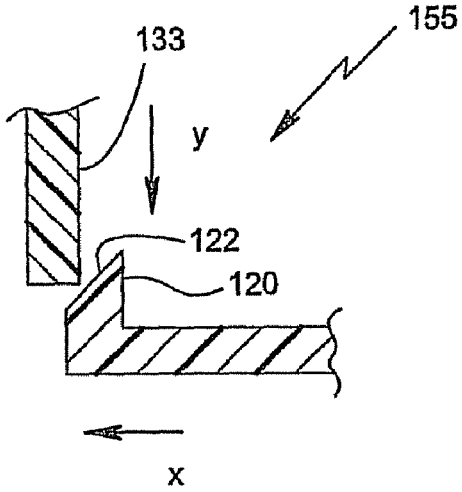
FIG. 4 is a schematic sectional side view of a cantilever snap fit mechanism in an unengaged position in accordance with an embodiment of the present invention.
Figure 5:
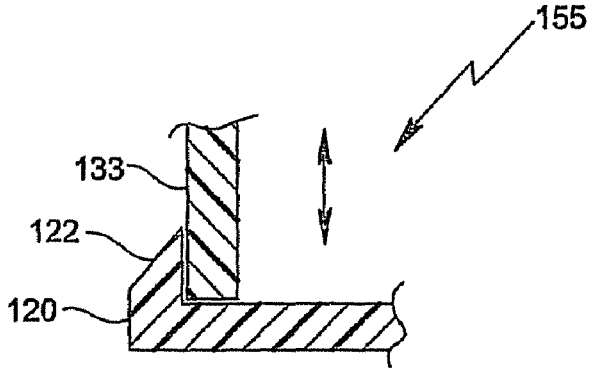
FIG. 5 is a schematic sectional side view of a cantilever snap fit mechanism in an engaged position in accordance with an embodiment of the present invention.

Referring to FIGS. 4 and 5, a close-up detail of the cantilever snap-fit mechanism 155 is shown. As shown in FIG. 4, in the unengaged position the first engaging structure can include a hooking mechanism 133 and the second engaging mechanism 120 can include a restraining tip 122 spaced apart from the hooking mechanism 133. When force is applied to the cantilever snap-fit mechanism 155 in either or both directions (x and y) indicated, the cantilever snap-fit mechanism 155 can become engaged. In the engaged position, as shown in FIG. 5, the restraining tip 122 of the second engaging mechanism 120 abuts the hooking mechanism 133. One or both of the hooking mechanism 133 and second engaging member 120 deflect in the x and/or y direction to permit the engagement of the cantilever snap-fit mechanism 155. Once engaged, the cantilever snap-fit mechanism 155 is designed not to disengage through normal operation. In one embodiment, the first channeled half and the second channeled half are configured to provide a liquid impermeable seal when the cantilever snap-fit mechanism 155 is engaged.

Referring again to FIGS. 2 and 3, the first engaging structure 118 can be integrally formed, such as co-extruded, within the first channeled half 112, and the second engaging structure 120 can be integrally formed within the second channeled half 114. In one embodiment, the first channeled half 112 can comprise multiple first engaging structures 118 and guides 118' oriented along a substantially lateral axis of the first channeled half. The second channeled half 114 can include multiple second engaging structures 120 and openings 120' (shown in FIG. 9) oriented along a substantially lateral axis of the second channeled half and aligned in mating orientation with the multiple first engaging structures 118 of the first channeled half 112.

Referring to FIG. 3, in another embodiment, at least one first engaging structure 118 and at least one corresponding second engaging structure 120 are positioned at a first location with respect to the pipe interior 116, and at least one first engaging structure 118 and at least one corresponding second engaging structure are positioned at a second location with respect to the pipe interior 116, apart from the first location. In another embodiment, the first location and the second location are substantially 1800 apart. In another embodiment, the first location and the second location are aligned along a substantially vertical axis V, such that at least one first engaging structure 118 and at least one corresponding second engaging structure 120 are positioned at the top of the pipe interior 116, and at least one first engaging structure 118 and at least one corresponding second engaging structure 120 are positioned at the bottom of the pipe interior 116.

Figure 7:
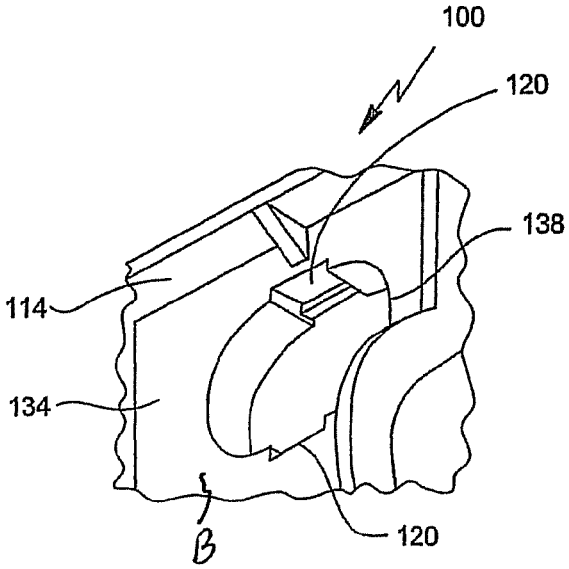
FIG. 7 is a perspective view of a cantilever snap-fit recess of a portional first channeled half of a slotted drain in accordance with an embodiment of the present invention.
Figure 6:
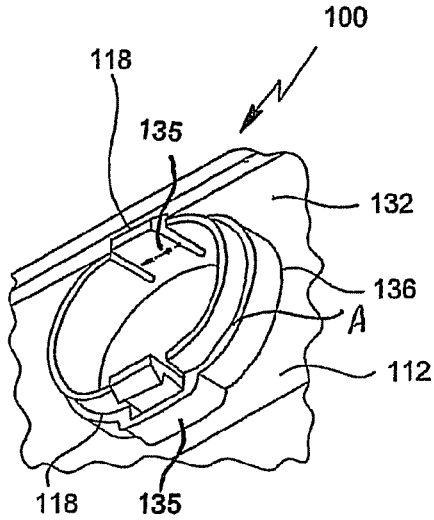
FIG. 6 is a perspective view of a cantilever snap-fit protrusion of a portional second channeled half of a slotted drain in accordance with an embodiment of the present invention.

As shown in FIGS. 2-3 and 6, the first channeled half 112 can include a first neck portion 132 having a first engaging structure 118 adjacent a first concrete pass-through half 136. As shown in FIGS. 2-3 and 7, the second channeled half 114 can include a second neck portion 134 having a second engaging structure 120 adjacent a second concrete pass-through half 138. Multiple first engaging structures 118 can be positioned adjacent the first concrete pass-through half 136 and multiple second engaging structures 120 can be positioned adjacent the second concrete pass-through half 138. The first concrete pass-through half 136 and the second concrete pass-through half 138 are alignable, such that a concrete pass-through port 130, structured and arranged to permit the flow of concrete or other suitable material therethough, is formed when the first channeled half 112 and the second channeled half 114 are joined. Referring again to FIGS. 6-7, in one embodiment, at least one concrete sealer port 135 can be positioned adjacent a first engaging structure 118 and/or adjacent a second engaging structure 120. In another embodiment, a concrete sealer port 135 can be positioned adjacent a concrete pass-through port 130. An abutting surface A preferably abuts a surface B when the first channeled half 112 is attached to the second channeled half 114 so that each concrete sealer port 130 isolates the respective first engaging structure 118 and the respective pass-through port 130 from the pipe interior 116. The concrete sealer ports 135 are structured to minimize the amount of wet concrete or other stabilizing material that may potentially seep into the slotted drain 100 during installation of the drain.

Figure 8:
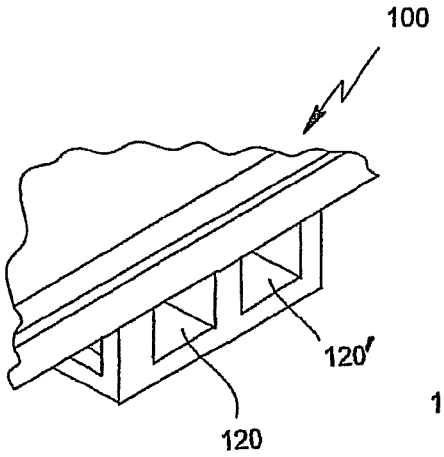
FIG. 8 is a perspective view of a cantilever snap-fit recess located on a bottom portion of a first channeled half of a slotted drain in accordance with an embodiment of the present invention.

It is contemplated herein, that alternative orientations of the first engaging structure and the second engaging structure may be provided. Although shown in FIGS. 1-3 as having a generally oval or circular shape, the second engaging structure 120 can have various configurations, such as having a generally square cross-section shown in FIG. 8. The corresponding first engaging structure 118 can also have various configurations, such as having a generally rectangular shape, shown in FIG. 9, and can optionally comprise an angled wedge restraining tip 122.

Figure 10:
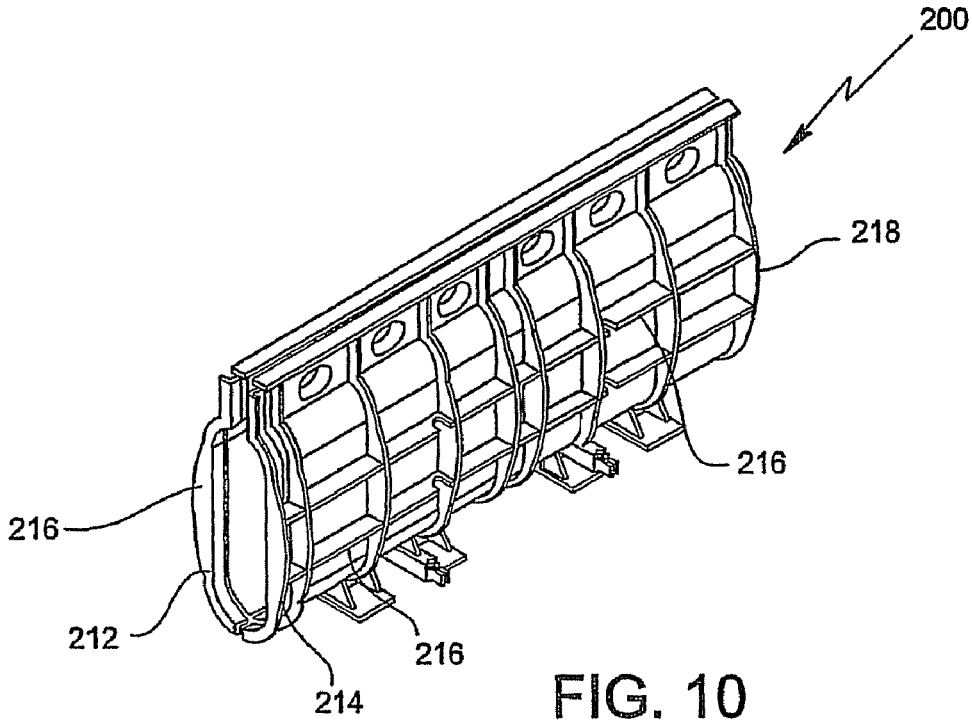
FIG. 10 is a perspective view of a slotted drain in accordance with an embodiment of the present invention.
Figure 11:
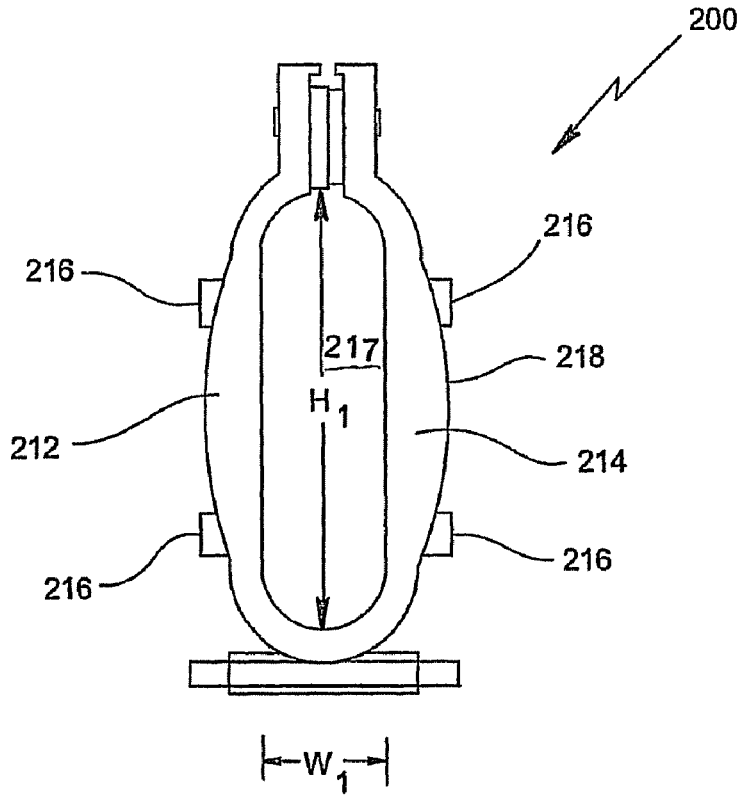
FIG. 11 is a front elevation view of the slotted drain shown in FIG. 10 in accordance with an embodiment of the present invention.

As shown in FIGS. 10 and 11, an alternative slotted drain 200 is shown. In this embodiment, the first channeled half 212 and the second channeled half 214 are structured to engage to form a pipe interior 217 having an extended height $H_1$. In one embodiment, the height $H_1$ can be from about four inches to about fourteen inches, and the width $W_1$ can be about four inches. In another embodiment, the slotted drain 200 can comprise at least one strengthening rib 216 for reinforcing the structural integrity of the slotted drain. The strengthening rib can extend in a substantially horizontal direction or in a substantially vertical direction along the slotted drain 200. In another embodiment, the strengthening rib 216 can be oriented along an exterior surface 218 of the slotted drain. In another embodiment, a plurality of strengthening ribs 216 can extend along the first channeled half 212 and a plurality of strengthening ribs 216 can extend along the second channeled half 214.

Figure 12:
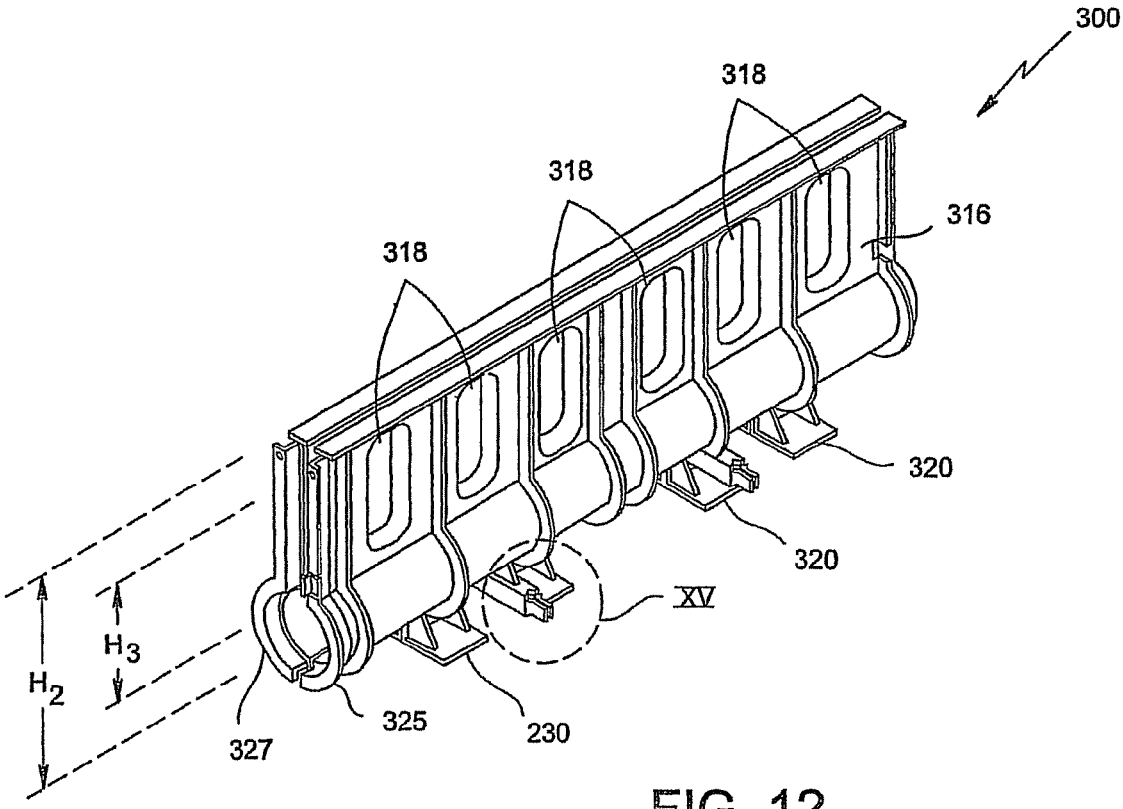
FIG. 12 is a perspective view of a slotted drain having a lengthened neck in accordance with an embodiment of the present invention.
Figure 13:
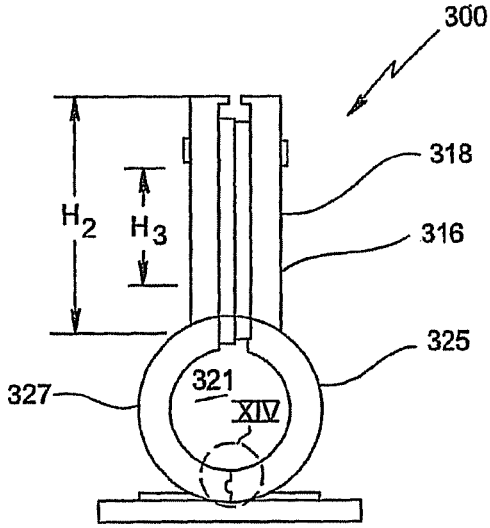
FIG. 13 is a front plan view of the slotted drain shown in FIG. 12 in accordance with an embodiment of the present invention.

As shown in FIGS. 12 and 13, an alternative slotted drain 300 is shown. In this embodiment, the first channeled half 327 and the second channeled half 325 are structured to engage to form an elongated neck portion 316 having a height $H_2$. In one embodiment, the height $H_2$ can be from about four inches to about eight inches. In this embodiment, the concrete pass-through ports 318 can have an elongated height $H_3$, such as from about two inches to about six inches. In this embodiment, the concrete pass-though ports 318 can have an increased surface area.

Figure 14:
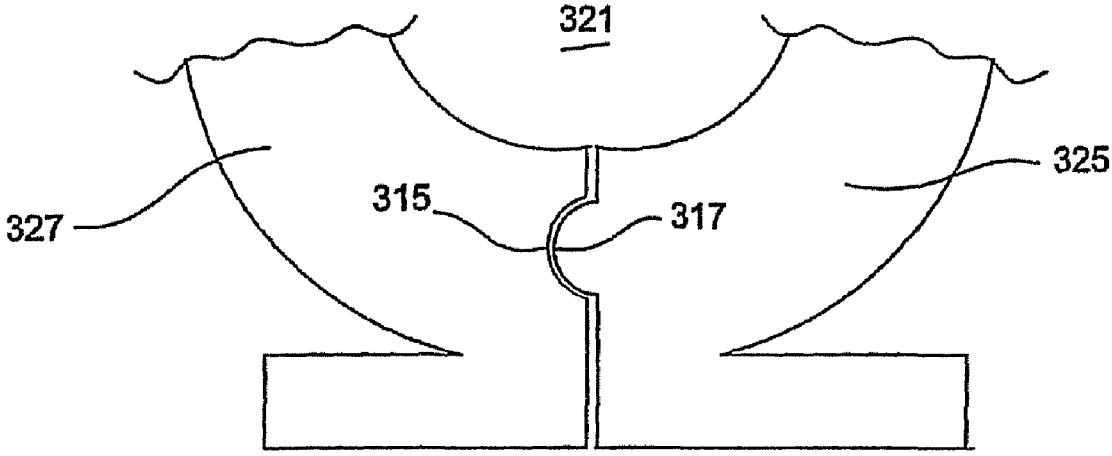
FIG. 14 is a close-up schematic side view of a bead and recess joining mechanism of the slotted drain shown in XIV of FIG. 13 in accordance with an embodiment of the present invention.

As shown in FIGS. 13 and 14, the first channeled half 327 and the second channeled half 325 are configured to engage to form a pipe interior 321. In one embodiment, the first channeled half 327 can define a recess 315 and the second channeled half can include an integrally molded bead 317 configured for receipt within the recess 315 in the engaged position. In the engaged position, the coupled bead 317 and recess 315 form a seal allowing substantially all liquid to pass within the pipe interior 321 without leaking. In another embodiment, a sealant, such as silicone and/or butyl rubber, and the like, is deposited on the surfaces of the recess 315 to improve the seal formed when the first channeled half 327 and the second channeled half 325 are joined.

Figure 15:
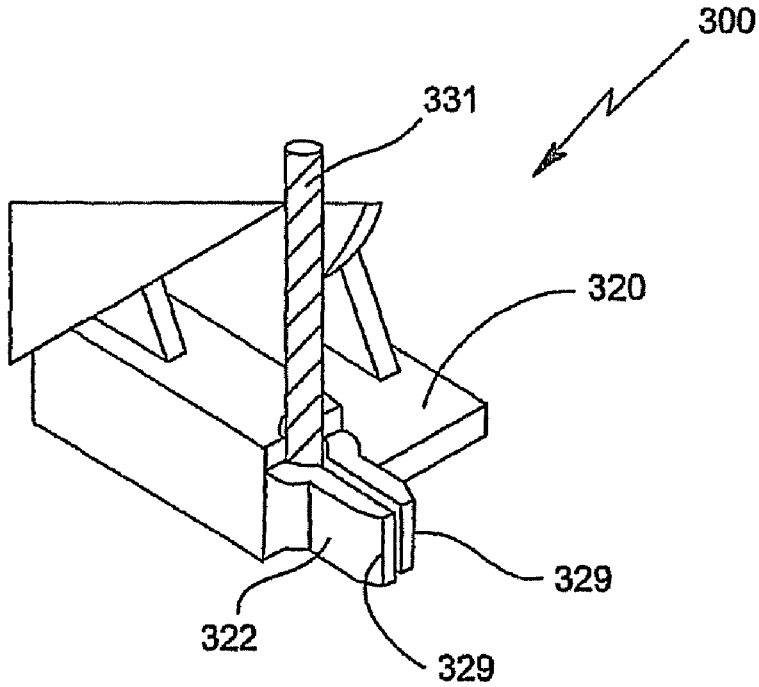
FIG. 15 is a close-up perspective view of the bedding foot and rebar clip shown in XV of FIG. 12 in accordance with an embodiment of the present invention.

In another embodiment, as shown in FIGS. 12 and 15, the slotted drain can include a plurality of bedding feet 320 for stabilizing the slotted drain 300. The bedding feet 320 can be integrally extruded or subsequently joined to the slotted drain 300, and allow for proper alignment of the slotted drain 300 within the desired area of installation, such as within a trench having an uneven bottom surface. The bedding feet 320 can have any suitable dimensions for supporting the slotted drain 300 and can be fabricated from any suitable material.

Referring again to FIGS. 12 and 15, the slotted drain 300 can also comprise a rebar clip 322 on an exterior surface 230. In one embodiment, the rebar clip 322 can be of any suitable size such as to restrain a piece of standard rebar therein, and can be positioned on a bedding foot 320. The rebar clip 322 can include any suitable restraining arrangement, such as spring-loaded clips, clips including a resistance material, a channel-lock arrangement, a press-fit arrangement, and the like. In operation, the rebar clip 322 can be used to restrain a piece of rebar for lowering the slotted drain 300 into a trench and/or to provide an anchor for rebar used to create a support structure for aligning the slotted drain 300. In another embodiment, the first channeled half 312 and the second channeled half 314 can each comprise a plurality of bedding feet 320 and rebar clips 322.

As shown in FIG. 15, the rebar clip 322 can restrain a piece of standard rebar 331 therein. In one embodiment, the rebar clip 322 includes a pair of retraining lips 329 which can be pushed apart during receipt of the rebar 331 and can spring together to restrain the rebar 331 therein after receipt. The rebar clip 322 and the bedding foot 320 can be coextruded and subsequently applied to the slotted drain or can be coextruded with the first channeled half and the second channeled half of the slotted drain.

Figure 16:
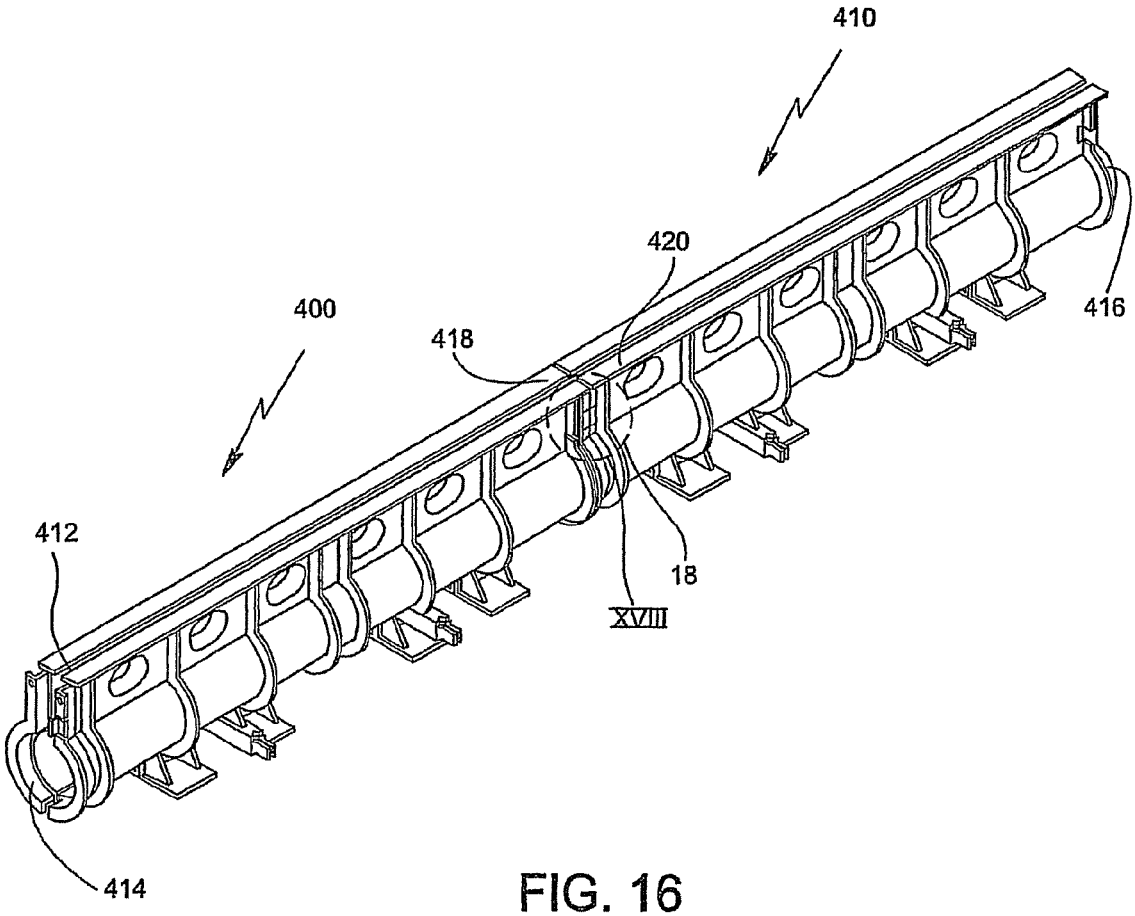
FIG. 16 is a perspective view of multiple slotted drains connected via a securement rib and corresponding fastener in accordance with an embodiment of the present invention.

As shown in FIG. 16, a plurality of slotted drains in accordance with the present invention may be utilized. A first slotted drain 400, as described herein, may be aligned with a second slotted drain 410 such that liquid entering the slot 412 of the first slotted drain may pass into the pipe interior 414 of the first slotted drain and subsequently pass into the pipe interior 416 of the second slotted drain 410. It is contemplated herein that the second slotted drain 410 may be placed in flow communication with another slotted drain (not shown) or a sewer, fluid collection tank, or fluid treatment process (also not shown).

Figure 17:
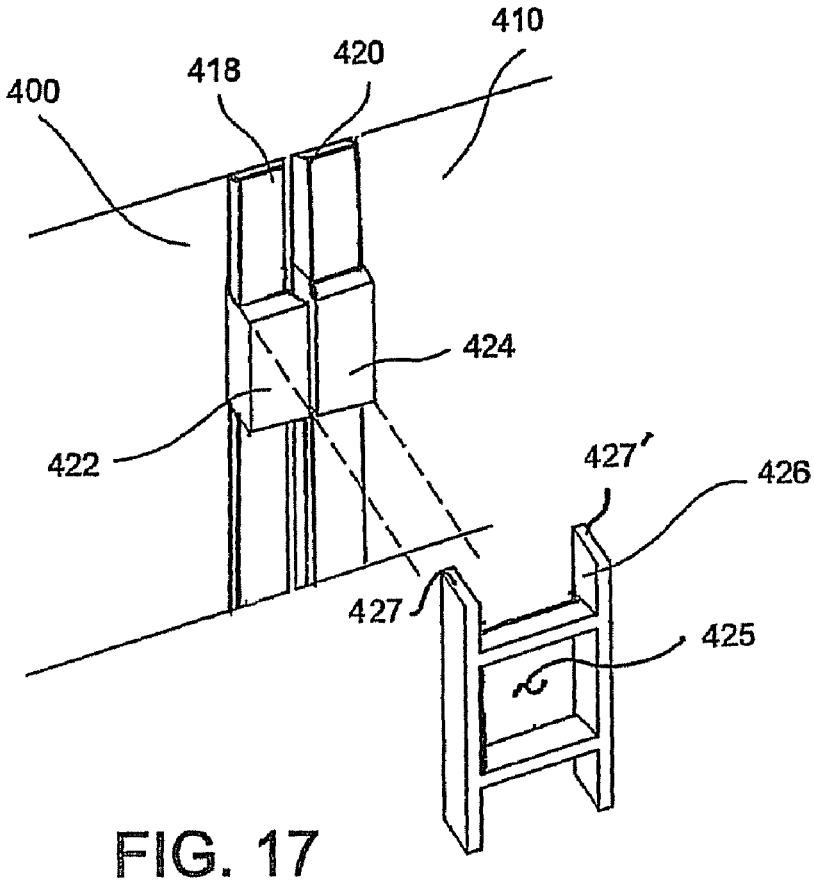
FIG. 17 is an exploded sectional view of the securement ribs and corresponding fastener shown in FIG. 16 in the unengaged position in accordance with an embodiment of the present invention.
Figure 18:
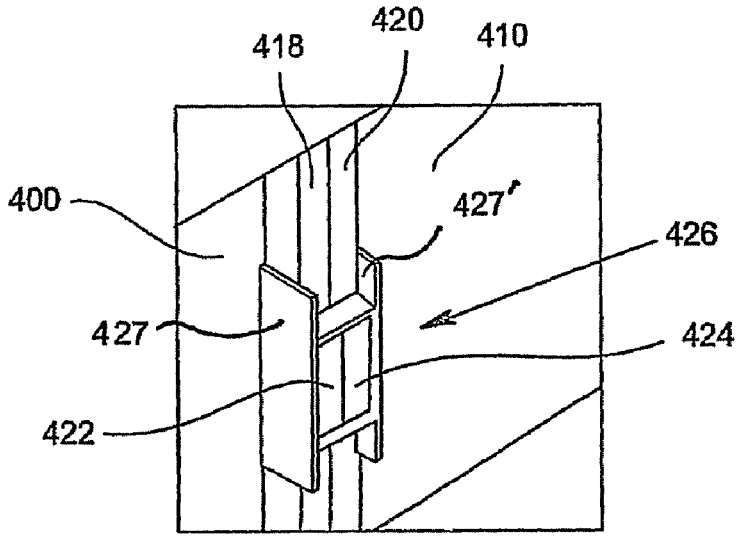
FIG. 18 is a close-up perspective view of the securement ribs and corresponding fastener as shown in XVIII of FIG. 17 in the engaged position in accordance with an embodiment of the present invention.

As shown in FIGS. 17-18, a distal end 418 of the first slotted drain 400 may include a securement rib 422 which extends outward of the exterior surface of the first slotted drain 400. A proximal end 420 of the second slotted drain 410 may include a corresponding securement rib 424 which also extends outward of the exterior surface of the second slotted drain 410. A fastener 426 may be positioned over or through the securement rib 422 of the first slotted drain 400 and the securement rib 424 of the second slotted drain 410 to secure the first slotted drain 400 with the second slotted drain 410. The fastener 426 is constructed to secure at least two surfaces together. Specifically, the fastener 426 acts as a clip receiving securement ribs 422, 424 within opening 425 and legs 427 and 427' abut outer surfaces of ends 418, 420 as shown in FIG. 18. In one embodiment, the fastener can comprise a screw, bolt, pin, snap, structure configured to be disposed over two adjoining surfaces, and the like. In another embodiment, a plurality of fasteners may be utilized, such as one on each side of the first and second slotted drains 400 and 410. It is contemplated herein that alternative fastener elements may be employed to join the first slotted drain and the second slotted drain without departing from the spirit of the presently claimed invention.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A slotted drain comprising:

a first channeled half having a first engaging structure and a first neck portion, the first engaging structure being formed on the first neck portion; and a second channeled half having a second engaging structure and having a second neck portion, the second engaging structure being formed on the second neck portion, the second engaging structure separate from the first engaging structure and adapted for mating within the first engaging structure, wherein the first channeled half and the second channeled half defining a pipe interior therebetween when the first channeled half and the second channeled half are joined, wherein the first neck portion and the second neck portion defining a slot therebetween in fluid communication with the pipe interior when the first channeled half and the second channeled half are joined, and wherein the first engaging structure defines a recess and the second engaging structure includes a protrusion received within the recess.

2. The slotted drain of claim 1, wherein the first engaging structure defines a snap-fit recess and the second engaging structure comprises a snap-fit protrusion configured for receipt within the snap-fit recess.

3. A slotted drain comprising:

a first channeled half having a first engaging structure and a first neck portion, the first engaging structure being formed on the first neck portion; and a second channeled half having a second engaging structure and having a second neck portion, the second engaging structure being formed on the second neck portion, the second engaging structure separate from the first engaging structure and adapted for mating within the first engaging structure, wherein the first channeled half and the second channeled half defining a pipe interior therebetween when the first channeled half and the second channeled half are joined, wherein the first neck portion and the second neck portion defining a slot therebetween in fluid communication with the pipe interior when the first channeled half and the second channeled half are joined, and wherein the first engaging structure defines a recess and the second engaging structure comprises a cantilever snap-fit protrusion.

4. The slotted drain of claim 3, wherein the cantilever snap-fit protrusion further includes a restraining tip.

5. The slotted drain of claim 1, wherein a slot is formed when the first channeled half and the second channeled half are joined.

6. The slotted drain of claim 1, wherein the first engaging structure is integrally formed within the first channeled half and the second engaging structure is integrally formed within the second channeled half.

7. The slotted drain of claim 1, wherein the first channeled half includes multiple first engaging structures and the second channeled half includes multiple second engaging structures.

8. A slotted drain comprising:

a first channeled half having a first engaging structure and a first neck portion, the first engaging structure being formed on the first neck portion; and a second channeled half having a second engaging structure and having a second neck portion, the second engaging structure being formed on the second neck portion, the second engaging structure separate from the first engaging structure and adapted for mating within the first engaging structure, wherein the first channeled half and the second channeled half defining a pipe interior therebetween when the first channeled half and the second channeled half are joined, wherein the first neck portion and the second neck portion defining a slot therebetween in fluid communication with the pipe interior when the first channeled half and the second channeled half are joined, wherein the first channeled half includes multiple first engaging structures and the second channeled half includes multiple second engaging structures, and wherein at least two first engaging structures are aligned along a substantially vertical axis and at least two second engaging structures are aligned along a corresponding substantially vertical axis.

9. The slotted drain of claim 1, wherein the first neck portion further comprises a first concrete pass-through port half adjacent the first engaging structure, and the second neck portion further comprises a second concrete pass-through port half alignable with the first concrete pass-through port half and adjacent the second engaging structure.

10. The slotted drain of claim 9, wherein a concrete pass-through port structured and arranged to permit concrete flow therethrough is formed when the first channeled half and the second channeled half are joined.

11. The slotted drain of claim 10, further comprising a concrete sealer port adjacent a concrete pass-through port.

12. The slotted drain of claim 1, further comprising at least one strengthening rib extending in a substantially horizontal direction along an exterior surface of the first channeled half and at least one strengthening rib extending in a substantially horizontal direction along an exterior surface of the second channeled half.

13. The slotted drain of claim 1, further comprising at least one rebar clip structured and arranged to receive rebar therein, the rebar clip integral with at least one of the first channeled half and the second channeled half.

14. The slotted drain of claim 1, further comprising at least one bedding foot integral with the first channeled half and/or the second channeled half.

15. The slotted drain of claim 14, further comprising at least one rebar clip integral with at least one bedding foot.

16. The slotted drain of claim 1, further comprising means for securing the slotted drain with a second slotted drain in flow communication therewith.

17. The slotted drain of claim 16, further comprising at least one securement rib adjacent a distal end of the slotted drain, structured and arranged to receive a fastener for securing the securement rib with a second securement rib of the second slotted drain.

18. A slotted drain comprising:

a first channeled half having a cantilever snap-fit recess and a first neck portion, the cantilever snap-fit recess being formed on the first neck portion; and a second channeled half having a cantilever snap-fit protrusion structured separate from the cantilever snap-fit recess and arranged for receipt within the cantilever snap-fit recess, the second channeled half having a second neck portion, the cantilever snap-fit protrusion being formed on the second neck portion, wherein the first channeled half and the second channeled half defining a pipe interior therebetween when the first channeled half and the second channeled half are joined, and wherein a slot is formed between the first neck portion and the second neck portion in fluid communication with the pipe interior when the first channeled half and the second channeled half are joined.

19. The slotted drain of claim 18, further comprising a first concrete pass-through port half adjacent the cantilever snap-fit recess, and the second concrete pass-through port half alignable with the first concrete pass-through port half and adjacent the cantilever snap-fit protrusion.

20. The slotted drain of claim 18, further comprising at least one rebar clip structured and arranged to receive rebar therein, the rebar clip integral with the first channeled half and/or the second channeled half.

21. The slotted drain of claim 18, further comprising at least one bedding foot integral with the first channeled half and/or the second channeled half.

22. The slotted drain of claim 18, further comprising means for securing the slotted drain with a second slotted drain in flow communication therewith.

23. The slotted drain of claim 18, further comprising at least one securement rib adjacent a distal end of the slotted drain, structured and arranged to receive a fastener for securing the securement rib with a second securement rib of the second slotted drain.

24. A method of assembling a slotted drain comprising:

providing a first channeled half having a cantilever snap-fit protrusion and a first neck portion to an area of assembly, the cantilever snap-fit protrusion being formed on the first neck portion;

providing a second channeled half having a cantilever snap-fit recess and a second neck portion to the area of assembly, the cantilever snap-fit recess separate from the cantilever snap-fit protrusion and being formed on the second neck portions;

joining the first channeled half and the second channeled half to define a pipe interior therebetween; and engaging the cantilever snap-fit protrusion within the cantilever snap-fit recess, thereby defining a slot therebetween in fluid communication with the pipe interior.

25. A slotted drain comprising:

a first channeled half having a first engaging structure and a first neck portion, the first engaging structure being formed on the first neck portion; and a second channeled half having a second engaging structure and having a second neck portion, the second engaging structure being formed on the second neck portion, the second engaging structure separate from the first engaging structure and adapted for mating within the first engaging structure, wherein the first channeled half and the second channeled half defining a pipe interior therebetween when the first channeled half and the second channeled half are joined, wherein the first neck portion and the second neck portion defining a slot therebetween in fluid communication with the pipe interior when the first channeled half and the second channeled half are joined, and wherein the first channeled half further includes a first base portion and a third engaging structure formed on the first base portion, the second channeled half further includes a second base portion and a fourth engaging structure formed on the second base portion, the fourth engaging structure separate from the third engaging structure and adapted for mating with the third engaging structure, and the first base portion and the second base portion are disposed below the pipe interior defined by the joined first channeled half and the second channeled half.

26. The slotted drain of claim 18, wherein the first channeled half further includes a first base portion and a cantilever snap-fit recess formed on the first base portion, the second channeled half further includes a second base portion and a cantilever snap-fit protrusion formed on the second base portion, the cantilever snap-fit protrusion on the second base portion being separate from the cantilever snap-fit recess on the first channeled half, and the first base portion and the second base portion are disposed below the pipe interior defined by the joined first channeled half and the second channeled half.

27. The slotted drain of claim 1, wherein the first neck portion and the second neck portion extend from the pipe interior to respective ends and the slot defined between the first neck portion and the second neck portion extends from the pipe interior to the ends of the first neck portion and the second neck portion such that the slot is in fluid communication with an exterior of the slotted drain at the ends of the first neck portion and the second neck portion, and the first engaging structure is formed on the first neck portion between the pipe interior and the end of the first neck portion and the second engaging structure is formed on the second neck portion between the pipe interior and the end of the second neck portion.

28. The slotted drain of claim 18, wherein the first neck portion and the second neck portion extend from the pipe interior to respective ends and the slot defined between the first neck portion and the second neck portion extends from the pipe interior to the ends of the first neck portion and the second neck portion such that the slot is in fluid communication with an exterior of the slotted drain at the ends of the first neck portion and the second neck portion, and the cantilever snap-fit recess is formed on the first neck portion between the pipe interior and the end of the first neck portion and the cantilever snap-fit protrusion is formed on the second neck portion between the pipe interior and the end of the second neck portion.

29. A slotted drain comprising:

a first channeled half having a first engaging structure and a first neck portion, the first engaging structure being formed on the first neck portion; and a second channeled half having a second engaging structure and having a second neck portion, the second engaging structure being formed on the second neck portion, the second engaging structure separate from the first engaging structure and adapted for mating within the first engaging structure, wherein the first channeled half and the second channeled half defining a pipe interior therebetween when the first channeled half and the second channeled half are joined, wherein the first neck portion and the second neck portion defining a slot therebetween in fluid communication with the pipe interior when the first channeled half and the second channeled half are joined, wherein the first neck portion further comprises a first concrete pass-through port half adjacent the first engaging structure, and the second neck portion further comprises a second concrete pass-through port half alignable with the first concrete pass-through port half and adjacent the second engaging structure, and wherein the first engaging structure forms a portion of a perimeter of the first concrete pass-through port and the second engaging structure forms a portion of a perimeter of the second concrete pass-through port.

30. The slotted drain of claim 19, wherein the cantilever snap-fit recess forms a portion of a perimeter of the first concrete pass-through port and the cantilever snap-fit protrusion forms a portion of a perimeter of the second concrete pass-through port.

* * * * *